US008193433B2

(12) United States Patent
Hong

(10) Patent No.: US 8,193,433 B2
(45) Date of Patent: Jun. 5, 2012

(54) BUILT-UP DRUM

(75) Inventor: G-Hong Hong, Taipei (TW)

(73) Assignee: Taiwan Falun Dafa Society, Taipei (TW)

( * ) Notice: Subject to any disclaimer, the term of this patent is extended or adjusted under 35 U.S.C. 154(b) by 11 days.

(21) Appl. No.: 12/755,633

(22) Filed: Apr. 7, 2010

(65) Prior Publication Data

US 2010/0192750 A1 Aug. 5, 2010

Related U.S. Application Data

(63) Continuation-in-part of application No. 12/081,097, filed on Apr. 10, 2008, now Pat. No. 7,723,594.

(30) Foreign Application Priority Data

Dec. 25, 2007 (TW) ..... 96149892 A
Jul. 5, 2009 (TW) ..... 98126339 A

(51) Int. Cl.
*G10D 13/02* (2006.01)

(52) U.S. Cl. ..... 84/411 R

(58) Field of Classification Search ..... 84/411 R, 84/421
See application file for complete search history.

(56) References Cited

U.S. PATENT DOCUMENTS

| | | | | |
|---|---|---|---|---|
| 3,827,021 | A | 7/1974 | Phelon | |
| 4,593,596 | A * | 6/1986 | Gauger | 84/421 |
| 4,779,509 | A | 10/1988 | Weir | |
| 5,760,668 | A | 6/1998 | Testa et al. | |
| 5,957,421 | A | 9/1999 | Barbour | |
| 6,121,528 | A | 9/2000 | May | |
| 6,172,289 | B1 | 1/2001 | Shelley | |
| 6,686,526 | B2 | 2/2004 | Ezbicki | |
| 6,686,527 | B2 | 2/2004 | Hagiwara | |
| 7,781,660 | B2 * | 8/2010 | Paterson | 84/412 |

* cited by examiner

*Primary Examiner* — Kimberly Lockett
(74) *Attorney, Agent, or Firm* — Thomas, Kayden, Horstemeyer & Risley, LLP

(57) ABSTRACT

A built-up drum includes a drum body and two drum faces. The drum body includes a plurality of body components of which each includes a base, two jammed portions, an inserting portion and an insertion slot. One end of the base extends to form the inserting portion and the insertion slot is formed in the other end of the base. The inserting portion of each body component is inserted into the insertion slot of another body component, so that the body components define a profile of the drum body. A top face and a bottom face of the base respectively extend to form the jammed portions for being jammed on the drum faces. Accordingly, the present invention can simplify structure components, lighten the drum, and be easily disassembled and assembled for convenient carry. Further, the drum body is expandable for having different sizes, which is convenient for use.

19 Claims, 8 Drawing Sheets

BUILT-UP DRUM

This application is a Continuation-In-Part application of U.S. application Ser. No. 12/081,097 filed on Apr. 10, 2008, which claims priority to Taiwan Application No. 96149892, filed on Dec. 25, 2007. The U.S. patent application identified above is incorporated here in its entirety to provide continuity of disclosure.

This application is also claiming the priority and benefits of Taiwan Application Ser. No. 98126339, filed Jul. 5, 2009.

BACKGROUND OF THE INVENTION

1. Field of the Invention

The present invention relates to a percussion instrument, and more particularly to a built-up drum.

2. Description of Related Art

Drums are one kind of common musical instrument, which are often used in various celebrations, such as concerts, ceremonies and so on. Among various musical instruments, drums are very important Drums are one kind of percussion instrument, as such they are often used for accompaniment, for example, for religious music. When drums are combined with other percussion instruments, the atmosphere will likely be warm and exciting, or easy and lively, so drums have strong expressive force in music.

However, whether small-sized drums or large-sized drums all need to be carried to sites of activities. Large-sized drums have large volume and are heavy themselves, so they need a large amount of manpower and space for carrying or transport. Though small-sized drums do not demonstrate this problem, the occupied space is remains large when many small-sized drums are carried. Further, conventional drums have integral drum bodies created during their manufacture. Additionally, their drum bodies and drum faces are combined firmly and cannot be disassembled into smaller parts before carrying, so conventional drums are very inconvenient for transport. Accordingly, conventional drums have shortcomings related to carrying, transport, and space during transport. This is a particular area in which there is significant need and in which improvement will be welcomed.

Hence, the inventors of the present invention believe that the shortcomings described above are able to be resolved and hereby urge the useful solutions presented in this description of the present invention which presents a useful design, and is an effective improvement.

SUMMARY OF THE INVENTION

A significant object of the present invention is to provide a built-up drum which can simplify structure components, reduce weight of the drum, and be easily disassembled and assembled for users to conveniently carry based on the built-up structure design. Further, the drum body is expandable for having different sizes, which is convenient for use and variety in musical capabilities.

To achieve the above-mentioned objective, a built-up drum in accordance with the present invention is provided. The built-up drum includes: a drum body which includes a plurality of body components of which each includes a base, two jammed portions, an inserting portion and an insertion slot, wherein a top face of the base and a bottom face of the base respectively extend to form the jammed portions, one end of the base extends to form the inserting portion while the insertion slot is formed in the other end of the base, the inserting portion of each body component is inserted into the insertion slot of another body component, the body components defining a profile of the drum body; and two drum faces which are respectively disposed on across a top opening of the drum body and across a bottom opening of the drum body and respectively jammed on the two jammed portions of each body component.

The efficacy of the present invention is as follows:

1. The body components constitute the drum body in the built-up mode simplifies the structure components, needs no extra locking components, lightens the drum body, and ensures that the drum is easily disassembled and assembled for users to carry, pack, and transport conveniently.

2. To increase the number of the body components can be to form the drum body with different sizes, which is convenient for use.

To further understand features and technical contents of the present invention, please refer to the following detailed description and drawings related the present invention. However, the drawings are only to be used as references and explanations, not to limit the present invention which is fully described only within the later presented claims.

DETAILED DESCRIPTION OF THE PREFERRED EMBODIMENTS

Please refer to FIGS. 1-4, the present invention provides a built-up drum which includes a drum body 1 and two drum faces 2.

Figure 2A:
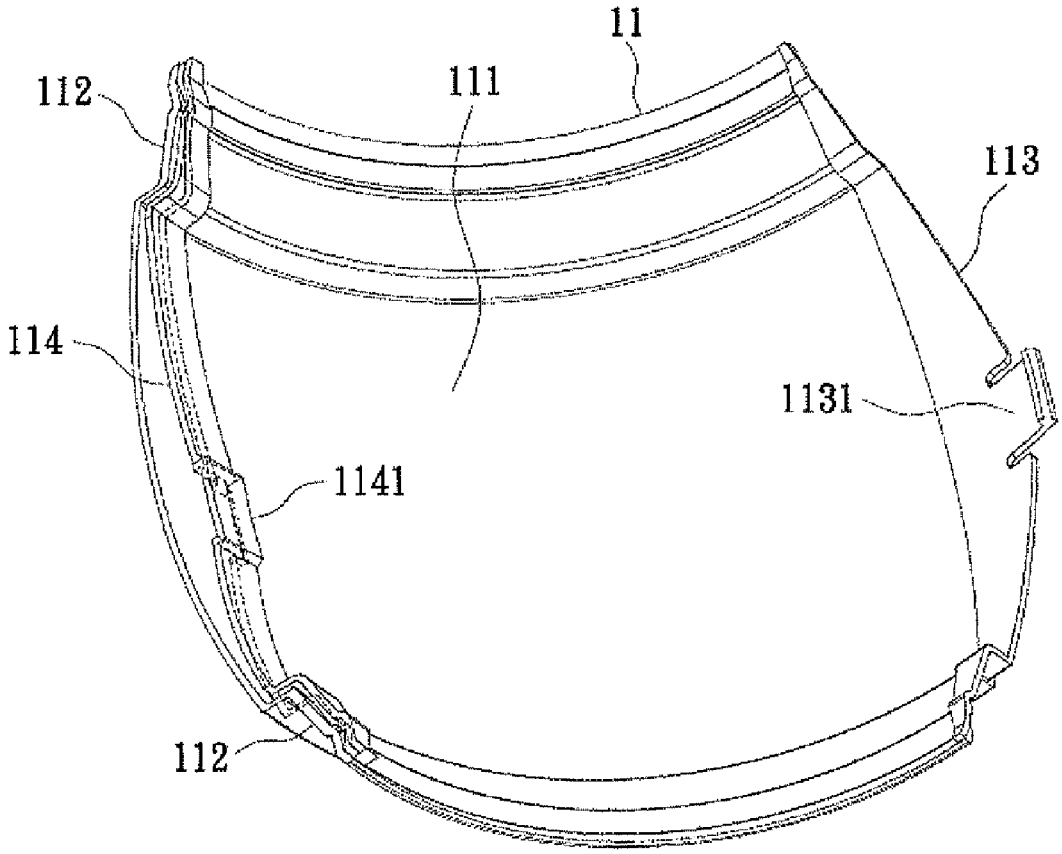
FIG. 2A is a perspective view of a body component of the present invention.
Figure 2B:
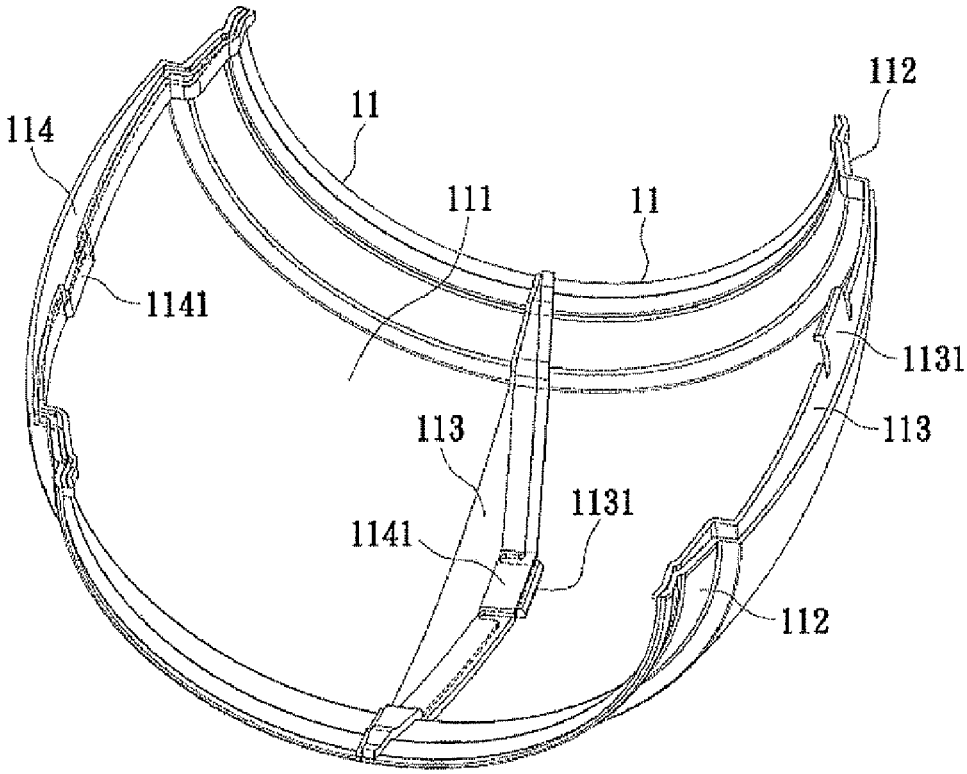
FIG. 2B is an assembled view of two body components of the present invention.
Figure 3:
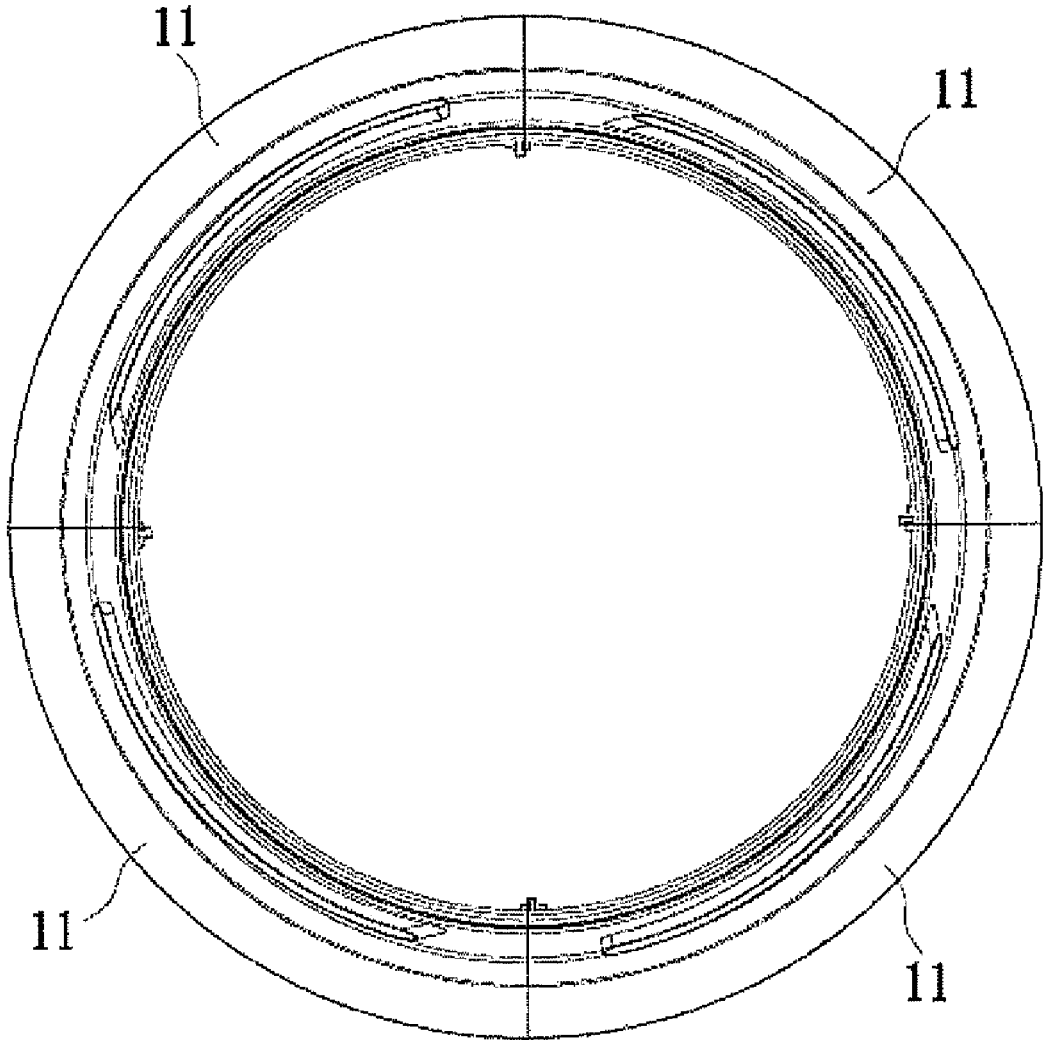
FIG. 3 is a top view of an assembled drum body of the present invention.

The drum body 1 includes four body components 11 each of which has the same size and shape. The body components 11 may be plastic components, metal alloy components, wood components or fiberglass components, each of which may be assembled with or disassembled from another body component 11. Each body component 11 includes a base 111, two jammed portions 112, an inserting portion 113 and an insertion slot 114 which are formed integrally. The base 111 is an arc-shaped thin shell and has a curvature radius, that is, the base 111 is bent from the middle portion to the two end portions in the direction of the center of curvature. The top face and the bottom face of the base 111 respectively extend to form the two jammed portions 112 which are symmetrically formed on the base 111. Each jammed portion 112 has a jammed flange 1121, of which one end is adjacent to the top face of the base 111 and the other end is adjacent to the bottom face of the base 111 so that the jammed flange 1121 is disposed slantways on the outer edge of the jammed portion 112. One end of the base 111 extends to form the inserting portion 113 (as shown in FIG. 2A and FIG. 2B) and the other end thereof has an insertion slot 114. The inserting portion 113 is a protruding portion, corresponding to the inserting portion 113 in shape and size. A fastened arm 1131 is disposed in the generally middle portion of the inserting portion 113, one end connected with the inserting portion 113 and the other end being a free end. A fastened frame 1141 is formed in the generally middle portion of the insertion slot 114, corresponding to the fastened arm 1131. The inserting portion 113 of each body component 11 is inserted into the insertion slot 114 of another body component 11, so that the fastened arm 1131 of each body component 11 extends into the fastened frame 1141 of another body component 11 to establish a secure fastening connection. Each two body components 11 are assembled with each other to constitute a profile of the drum body 1, that is, the body components 11 constitute the drum body 1 in a built-up mode (as shown in FIG. 3). Therefore, portions of each body component 11 may buckle another body component 11 by extending the fastened arm 1131 into the fastened frame 1141.

Figure 4:
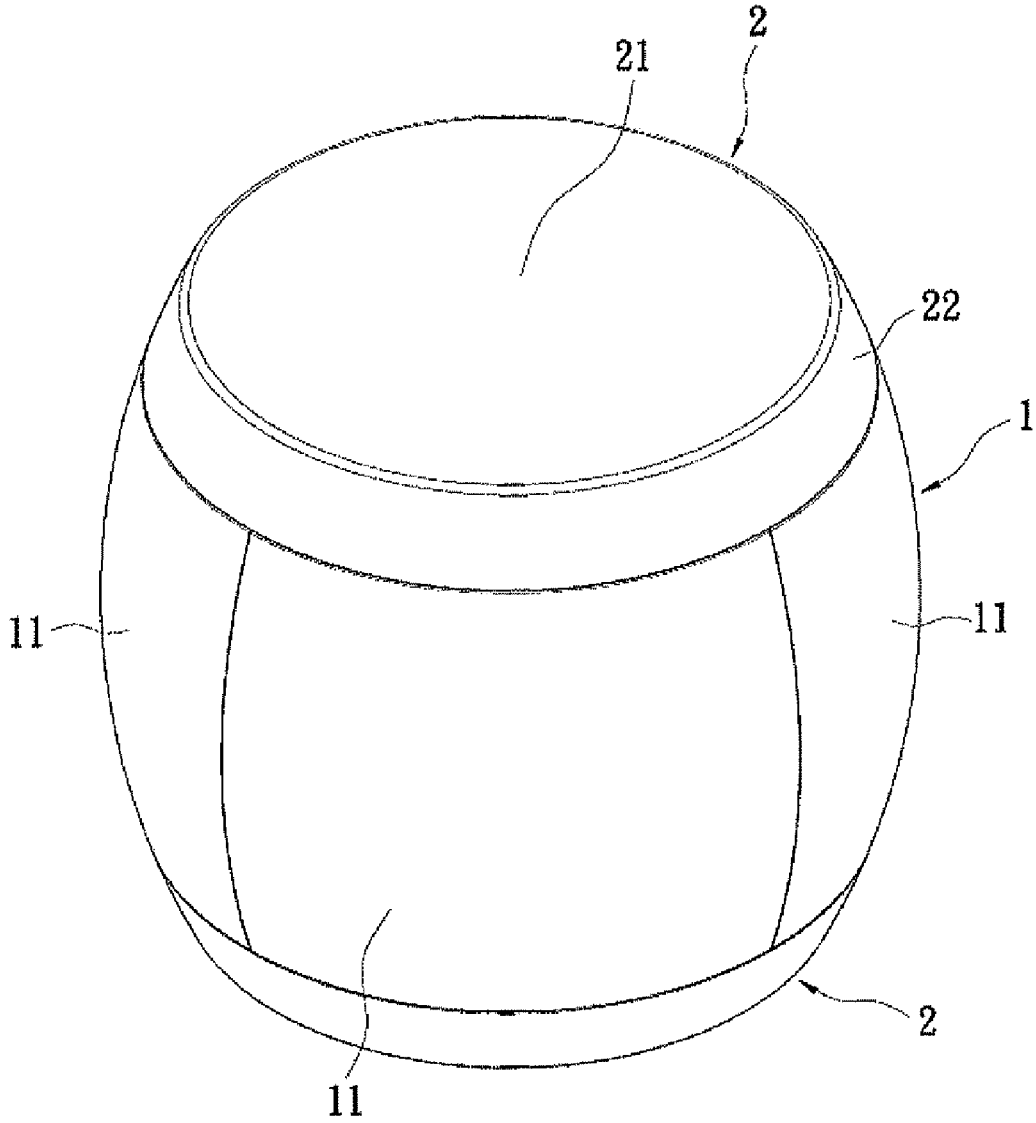
FIG. 4 is a perspective view of the built-up drum of the present invention.
Figure 7:
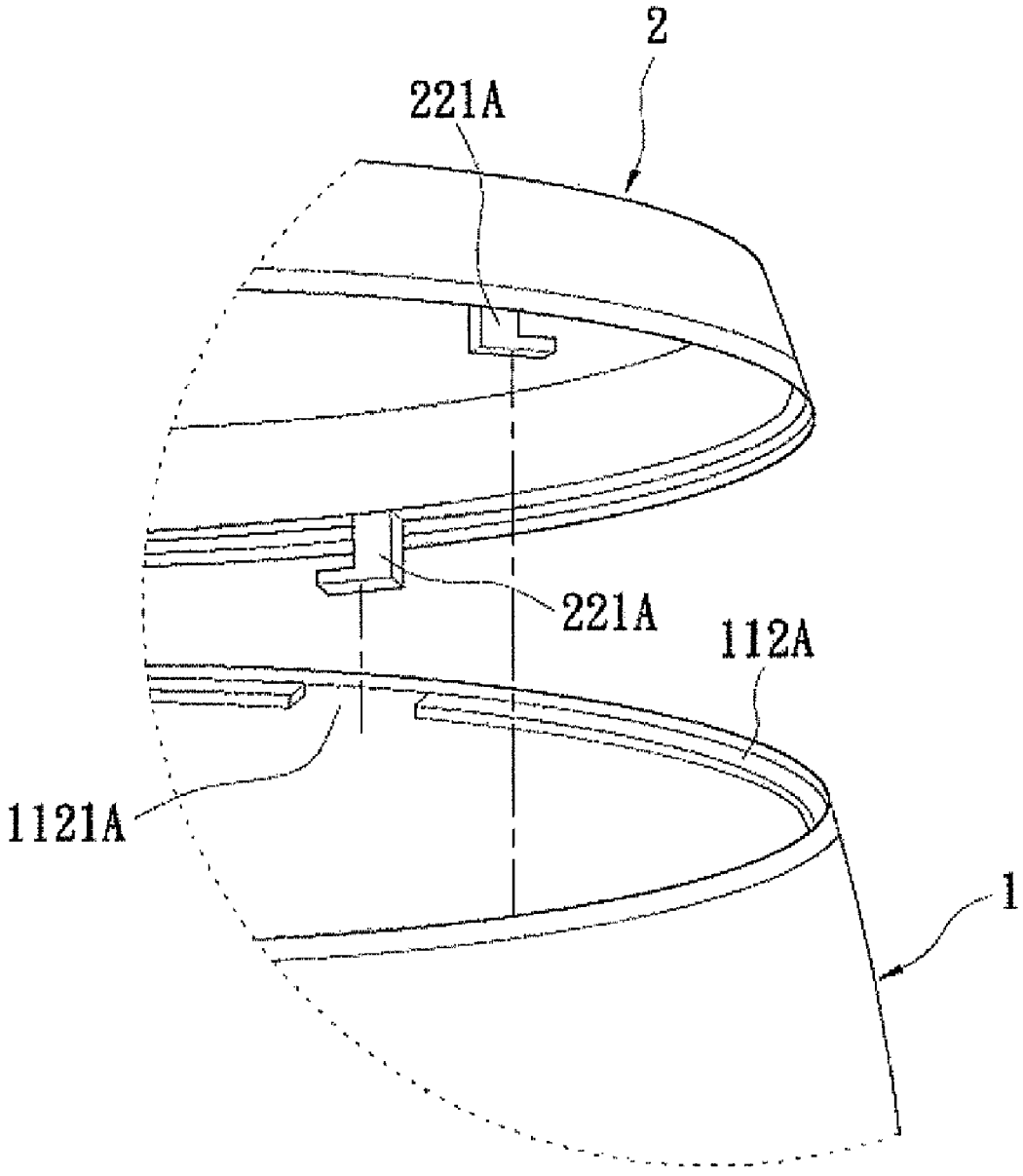
FIG. 7 is a schematic view of further another embodiment of the drum body of present invention combined with the drum faces.

The two drum faces 2 have the same size and shape and are symmetrically disposed on across the top opening and the bottom opening of the drum body 1 (as shown in FIG. 4). Each of the two drum faces 2 has a beaten portion 21 and a fixed portion 22 formed by extending the periphery of the beaten portion 21 downwards. A plurality of fixed flanges 221 is formed on the inner edge of the fixed portion 22. The number and positions of the fixed flanges 221 correspond to those of the jammed flanges 1121, so that each fixed flange 221 may move from one end of the corresponding jammed flange 1121 to the other end, thereby forming a jammed fixation to respectively jam the two drum faces 21 on the top opening and the bottom opening of the drum body 1. Furthermore, the beaten portion 21 is a circular body, and the radius of circumference of the beaten portion 21 is equal to the curvature radius of the base 111 to ensure that the two drum faces 21 are securely jammed on the drum body 1. However, the jammed flanges 1121 may be male threads and the fixed flanges 221 may be female threads corresponding to the male threads so that the two drum faces 2 may combine with the drum body 1 by screwing male threads and the female threads together. Moreover, the fixed flanges 221 may be replace with L-shaped rods 221A (as shown in FIG. 7). Each jammed portion 112A of each body component 11 provided with openings 1121A corresponding in number and location to the L-shaped rods 221A so that the two drum faces 2 may combine with the drum body 1 by buckling the L-shaped rods 221A into the openings 1121A respectively.

Figure 5:
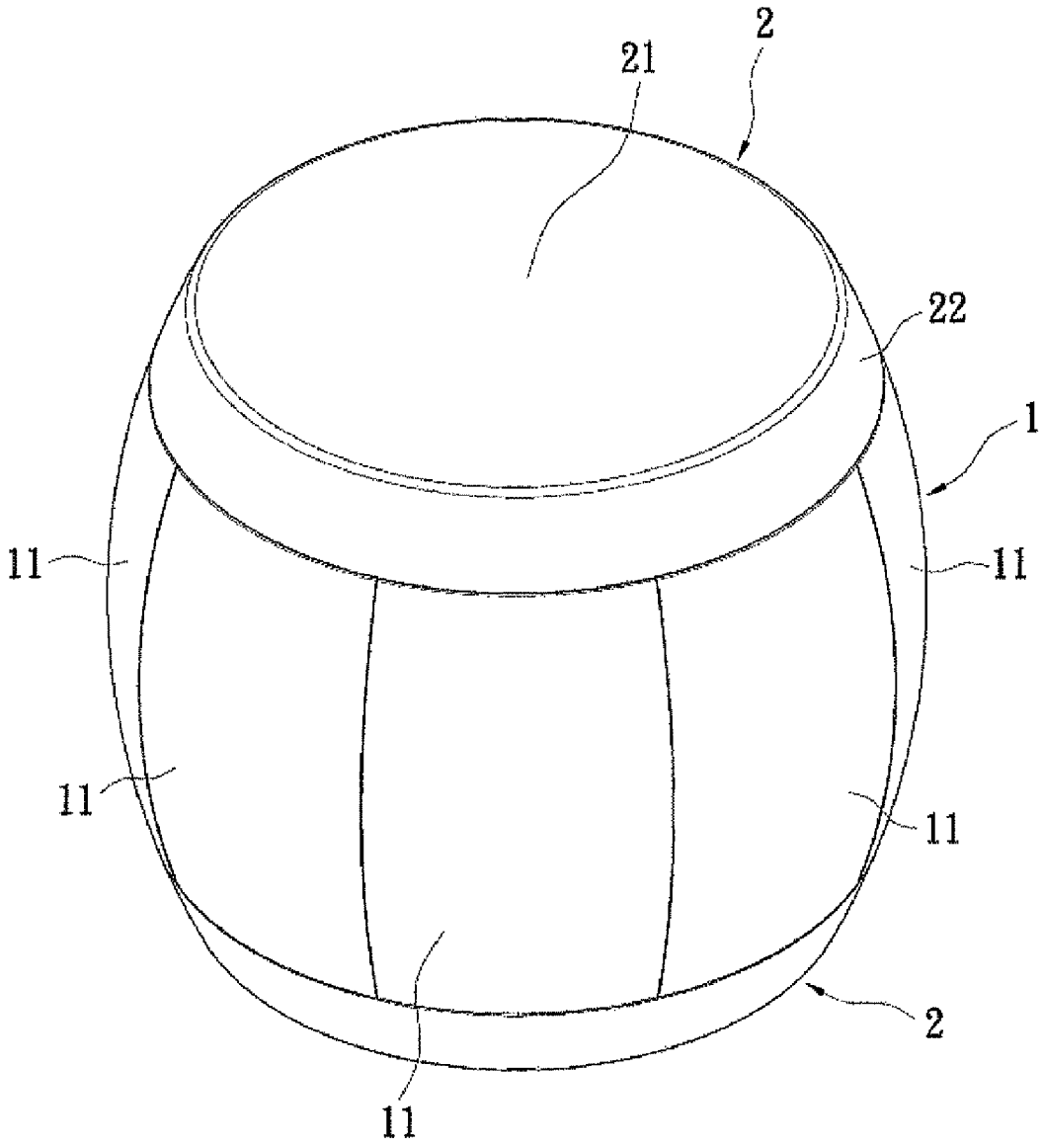
FIG. 5 is a perspective view of a different embodiment of the built-up drum of the present invention.
Figure 6:
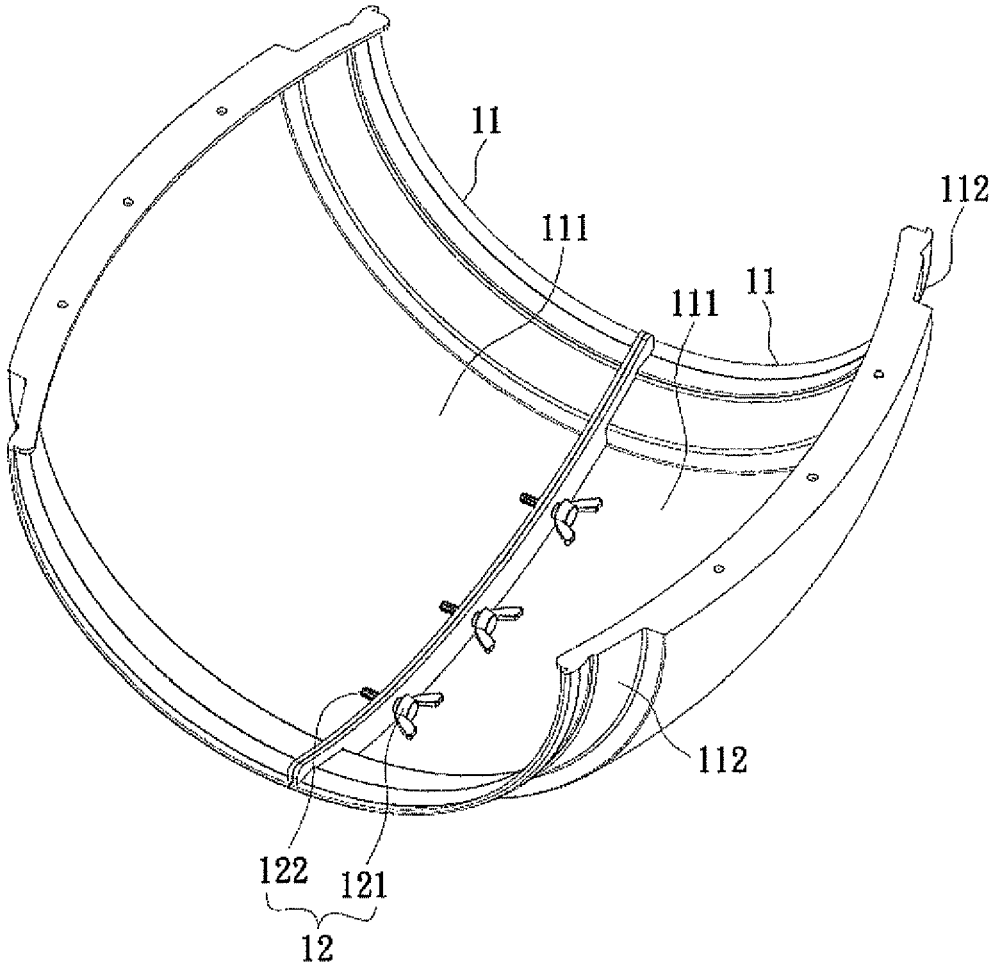
FIG. 6 is a schematic view of another embodiment of the drum body of the present invention.

Please refer to FIG. 5, in the present invention, the number of the body components 11 and the size of the drum faces 2 may vary depending on different designs. The number of the body components 11 may increase to eight in order that the body components 11 can constitute the larger drum body 1 in the built-up mode. Then the size of the drum faces 21 increases, corresponding to the size of the drum body 1, so that the radius of circumference of the beaten portion 21 is equal to the curvature radius of the base 111, thereby meeting the demand for use. But the number of the body components 11 isn't limited, and may increase or decrease properly, for example, the number of the body components 11 may be two, three, five, six or seven, so that the body components 11 can constitute the drum body 1 in the built-up mode, thereby achieving the efficacy of the present invention. The above-mentioned features, such as the jammed portions 112, the inserting portions 113 and the insertion slots 114 and so on, are only the preferred embodiment of the present invention, and any body component 11 which can constitute the drum body 1 in the built-up mode should be in the scope of the present invention. For example, in another embodiment of the drum body of the present invention, as shown in FIG. 6. One of the body component 11 of the drum body 1 may be joined with another one of the body component 11 of the drum body 1 by joining components 12. Each joining components 12 has a first joining component 121 and a second joining component 122 corresponding to the first joining component 121 so that the first joining component 121 may combine with the second joining component 122. However, the first joining components 121 may be screws and the second joining components 122 may be nuts. The user can use the joining components 12 to assemble the body component 11 for constituting the drum body 1

Figure 1:
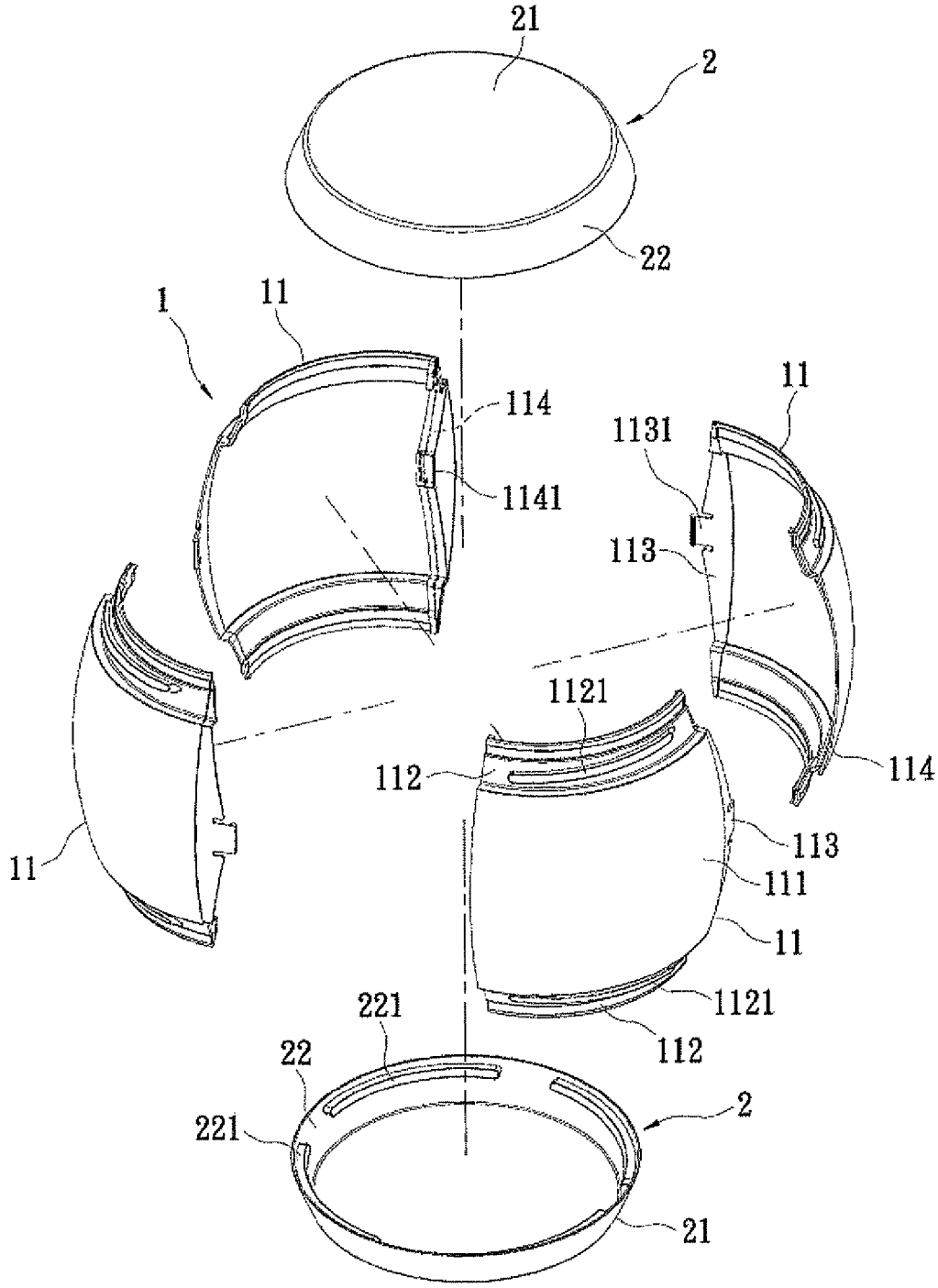
FIG. 1 is an exploded view of a built-up drum of the present invention.

According to the preferred embodiment of the present invention, as shown in FIG. 1, the drum body 1 and the drum faces 2 can be assembled without using a screw driver and screws. It helps the user avoid loosing the small screws after disassembling the screws and using another screws to replace the loosed screws, and need no screw driver for assembling or disassembling the built-up drum. In the embodiment of the present invention, the built-up drum can be assembled via the combination of the structures of the drum body 1 and the drum faces 2 without carrying extra tools for assembling. Actually, the combination of the drum body 1 may not be limited by above methods and also may use screws or other components for combining the drum body 1.

Consequently, the present invention has the advantages as follows:

1. That the body components 11 constitute the drum body 1 in the built-up mode simplifies the structure components, needs no extra locking components, lightens the drum body 1, and ensures that the drum is easily disassembled and assembled for users to carry conveniently.

2. To increase the number of the body components can be to form the drum body 1 with different sizes, that is, the number of the body components 11 can be increased or decreased depending on the demands, which is convenient for use.

3. When some body components 11 are damaged, it only needs to replace the damaged body components 11 with new body components, instead of replacing the drum.

What is disclosed above includes only the specification and the drawings of the preferred embodiment of the present invention and it is therefore not intended that the present invention be limited to the particular embodiment disclosed. It will be understood by those skilled in the art that various equivalent changes may be made depending on the specification and the drawings of the present invention without departing from the scope of the present invention. The full scope if this invention is fully described only by the following claims.

What is claimed is:

1. A built-up drum, comprising:

a drum body, including a plurality of body components of which each includes a base, two jammed portions, an inserting portion and an insertion slot, wherein a top face of the base and a bottom face of the base respectively extend to form the jammed portions, one end of the base extends to form the inserting portion while the insertion slot is formed in the other end of the base, the inserting portion of each body component is inserted into the insertion slot of another body component, the body components defining a profile of the drum body; and two drum faces, respectively disposed on across a top opening of the drum body and across a bottom opening of the drum body and respectively jammed on the two jammed portions of each body component.

2. The built-up drum as claimed in claim 1, wherein each inserting portion has a fastened arm, each insertion slot has a fastened frame corresponding to the fastened arm, and the fastened arm of each body component extends into the fastened frame of another fastened frame to establish a fastening connection.

3. The built-up drum as claimed in claim 1, wherein the number of the body components is four.

4. The built-up drum as claimed in claim 1, wherein the base, the jammed portions, the inserting portion and the insertion slot of each body component are formed integrally.

5. The built-up drum as claimed in claim 1, wherein the base is an arc-shaped thin shell and has a curvature radius, and the base is bent from a middle portion thereof to two end portions thereof in the direction of the center of curvature; each of the two drum faces has a beaten portion and a fixed portion formed by extending a periphery of the beaten portion downwards, and the beaten portion is a circular body; and a radius of circumference of the beaten portion is equal to the curvature radius of the base.

6. The built-up drum as claimed in claim 5, wherein each of the two jammed portions has a jammed flange disposed slantways thereon, the fixed portion of each of the two drum faces has a plurality of fixed flanges, and the number and positions of the fixed flanges correspond to those of the jammed flanges, and each fixed flange moves from one end of the corresponding jammed flange to the other end to form a jammed fixation.

7. A detachable drum body, which may form a built-up drum with a drum face, comprising:

a drum body, having a plurality of body components of which each may be combined with another body component, wherein each body component includes a base, at least one jammed portion, an inserting portion and an insertion slot.

8. The detachable drum body as claimed in claim 7, wherein the inserting portion of each body component is assembled with the insertion slot of another body component, and the at least one jammed portion and the drum face are assembled to form the built-up drum.

9. The detachable drum body as claimed in claim 7, wherein the base is an arc-shaped thin shell.

10. The detachable drum body as claimed in claim 7, wherein one of the body component may be joined with another one of the body component by joining components.

11. The detachable drum body as claimed in claim 7, wherein portions of each body component may buckle another body component.

12. The detachable drum body as claimed in claim 7, wherein each body component includes an inserting portion and an insertion slot, one end of body component extends to form the inserting portion while the insertion slot is formed in the other end of the body component, the inserting portion of each body component is inserted into the insertion slot of another body component.

13. A built-up drum, comprising:

at least one drum face; and a drum body, wherein the at least one drum face is disposed on the drum body, and the drum body includes a plurality of body components of which each is combined with another body component, wherein each body component includes a base, at least one jammed portion, an inserting portion and an insertion slot.

14. The built-up drum as claimed in claim 13, wherein the at least one drum face each has a beaten portion and a fixed portion formed by extending a periphery of the beaten portion downwards, and the fixed portion has at least one fixed flange formed on an inner edge thereof.

15. The built-up drum as claimed in claim 14, wherein each body component includes at least one jammed portion which has at least one jammed flange and the number and positions of the fixed flanges correspond to those of the jammed flanges.

16. The built-up drum as claimed in claim 15, wherein one end of the base extends to form the inserting portion and the insertion slot is formed in the other end of the base, and the shape and size of the inserting portion corresponds to that of the insertion slot.

17. The built-up drum as claimed in claim 15, wherein the base is an arc-shaped thin shell.

18. The built-up drum as claimed in claim 15, wherein the jammed flange may be a male thread and the fixed flange may be a female thread corresponding to the male thread so that the drum face may combine with the drum body by screwing male thread and the female thread together.

19. The built-up drum as claimed in claim 13, wherein the at least one drum face each has a beaten portion and a fixed portion formed by extending a periphery of the beaten portion downwards, and the fixed portion has at least one L-shaped rod formed on an inner edge thereof.

* * * * *